US006003821A

United States Patent [19]

Fabian et al.

[11] Patent Number: 6,003,821

[45] Date of Patent: Dec. 21, 1999

[54] DECORATIVE HOLDER FOR A BABY BOTTLE

[76] Inventors: Bob Fabian, 27483 Stratford St.; Danny Manthis, 6938 Olive St., both of Highland, Calif. 92346

[21] Appl. No.: 09/181,755

[22] Filed: Oct. 29, 1998

[51] Int. Cl.[6] ..... A47D 15/00

[52] U.S. Cl. ..... 248/104; 248/918

[58] Field of Search ..... 248/102, 104, 248/106, 107, 103, 105, 918, 915; 446/370, 374, 227

[56] References Cited

U.S. PATENT DOCUMENTS

| | | | |
|---|---|---|---|
| 4,320,883 | 3/1982 | Bass | 248/104 |
| 5,072,843 | 12/1991 | James | 248/102 X |
| 5,083,732 | 1/1992 | Akamine | 248/104 |
| 5,192,041 | 3/1993 | Bryant | 248/104 |
| 5,217,192 | 6/1993 | Oktayuren | 248/102 |
| 5,489,075 | 2/1996 | Ible | 248/104 |
| 5,871,184 | 2/1999 | Kaoplo | 248/102 |
| 5,873,551 | 2/1999 | Jones | 248/102 |

*Primary Examiner*—Ramon O. Ramirez
*Attorney, Agent, or Firm*—Timothy Thut Tyson; Ted Masters; Freilich, Hornbaker & Rosen

[57] ABSTRACT

A decorative holder for a baby bottle includes a flexible arm having a bottle receiver at one end and a clamp at the opposite end. A decorative cover in the form of an animal is removably wrapped around the flexible arm, with the animal's head near the bottle receiver and the animal's groin near the clamp. A baby bottle is placed in the bottle receiver, the clamp is attached to a support structure such as a crib, and the flexible arm is positioned so the baby can feed.

5 Claims, 6 Drawing Sheets

DECORATIVE HOLDER FOR A BABY BOTTLE

TECHNICAL FIELD

The present invention relates generally to the field of feeding babies, and in particular to a holder for a baby bottle having a flexible arm which is surrounded by a removable decorative cover shaped like an animal.

BACKGROUND ART

Devices designed to hold the bottle of a feeding baby are well known in the art. To avoid the tedious chore of continuously manually holding the bottle as the child feeds, one common practice is to wrap the bottle in a blanket or towel and prop the bottle in a feeding position. However, this method is oftentimes inadequate since the bottle can be easily moved away from or otherwise dislodged from the baby's mouth. To address this problem, a variety of bottle holders have been devised. For example, U.S. Pat. No. 3,620,491 illustrates a nursing bottle holder in which a bottle is carried in a pivot mount which is releasably secured on a support member, the support member being formed to straddle a baby. This allows the baby to feed from the bottle and also permits ready removal of the pivot mount from the support member. U.S. Pat. No. 4,295,293 discloses a nursing bottle holder. The device includes a main support member in the form of a shell which fits over the body of the infant when the infant is lying down, an upright bottle support having a caricature removably mounted on the main support for mounting the bottle, and a bottle carriage which is pivotable between an active feeding position and an inactive released position. The bottle support includes a music box which is activated in the inactive position. U.S. Pat. No. 4,320,883 defines a positionable toy/bottle holder comprising interchangeable head members with openings representing the mouth of the characterization which the head represents. The opening contains a groove or channel for receiving and holding a resilient ring member which grasps and firmly holds a baby bottle. An extension arm supports the head member at a distance spaced from a base member. The extension arm, head and base member attachments are pivotable. U.S. Pat. No. 5,083,732 consists of a flexible baby bottle holding animal. A single piece flexible holding device has four major components: a multi-use clamp, a flexible rod, a protective sheath cover which provides protection for safe use, beauty, and is designed to bend with the movements of the flexible rod, and a flexible holding grip for holding a bottle.

DISCLOSURE OF INVENTION

The present invention allows a baby to safely and effectively feed from a bottle without the need for someone to continuously hold the bottle. The mother or father can perform other tasks such as working on a computer, doing dishes, writing, working on a car, or talking on the phone while only occasionally glancing at the child to ensure that the feeding operation is progressing properly. The holder of the present invention includes a flexible arm which has a bottle receiver for grasping the bottle at one end and an attachment clamp for attaching the holder to a support structure at the other end. A removable decorative cover in the shape of an animal wraps around the flexible arm and gives the impression that it is the animal that is holding the bottle and feeding the baby. A preferred name for the present invention is "The Mother's Arm".

The present invention incorporates numerous useful features and advantages. The decorative cover in the form of a soft cuddly animal is attractive to both the parents and the baby. The animal is cute and keeps the child entertained during feeding. Additionally, the placement of the animal upon the holder gives the impression that it is the animal that is performing the feeding operation, thereby further enhancing the entertainment value. The decorative animal covering is removable for easy cleaning and washing. The animal can also be removed and left with the baby, or wrapped around other objects such as cribs and pole lamps. Additionally, different animal covers can be used thereby providing variety and avoiding boredom to the baby.

The holder fits any bottle and securely clamps to carriers, car seats, cribs, strollers, and the like, and once clamped, stays firmly in position. The arm of the holder is completely flexible, allowing the holder to be placed in any desired position. The holder can always be adjusted so that the animal is facing the baby. The holder keeps the bottle clean by not allowing it to drop onto the floor or ground.

The holder is safe. It has no removable parts that a baby can swallow. The bottle receiver which holds the bottle is fabricated from soft pliable material and contains no solid parts or sharp edges that could harm the baby. Further, the child can easily move the holder out of the way or push the bottle away when they are not wanted.

The flexible arm may be folded out of the way after the completion of feeding without disconnecting the clamp. Conversely, the arm may be positioned so the baby can play with the decorative animal covering.

In accordance with a preferred embodiment of the invention, a holder for a baby bottle includes a flexible arm having a first end and an opposite second end. A bottle receiver is connected to the first end and a clamp is connected to the second end. A decorative cover in the form of an attractive animal is removably attachable to the first and second ends of the flexible arm with the animal's head located near the bottle receiver and the animal's groin located near the clamp.

In accordance with an important aspect of the invention, the decorative cover is attached to the flexible arm by hook and loop attachment means such as Velcro®.

In accordance with an important feature of the invention, the animal is wrapped around the flexible arm so that the animal straddles the arm.

In accordance with another important aspect of the invention, the decorative cover has two spaced cooperating fasteners located on the chest of the animal, the two spaced cooperating fasteners selectively retaining the decorative cover around the flexible arm.

In accordance with another important feature of the invention, the animal has at least two limbs which are selectively fastenable together so as to surround the flexible arm. The two limbs are also selectively fastenable together so as to surround and hold the baby bottle.

In accordance with an aspect of the invention, the body of the animal is made of fabric or other soft flexible material and is substantially flat so that it can be wrapped around the flexible arm. Other parts of the animal, such as the head and limbs, can be stuffed to provide a natural look.

Other features and advantages of the present invention will become apparent from the following detailed description, taken in conjunction with the accompanying drawings, which illustrate, by way of example, the principles of the invention.

MODES FOR CARRYING OUT THE INVENTION

Figure 1:
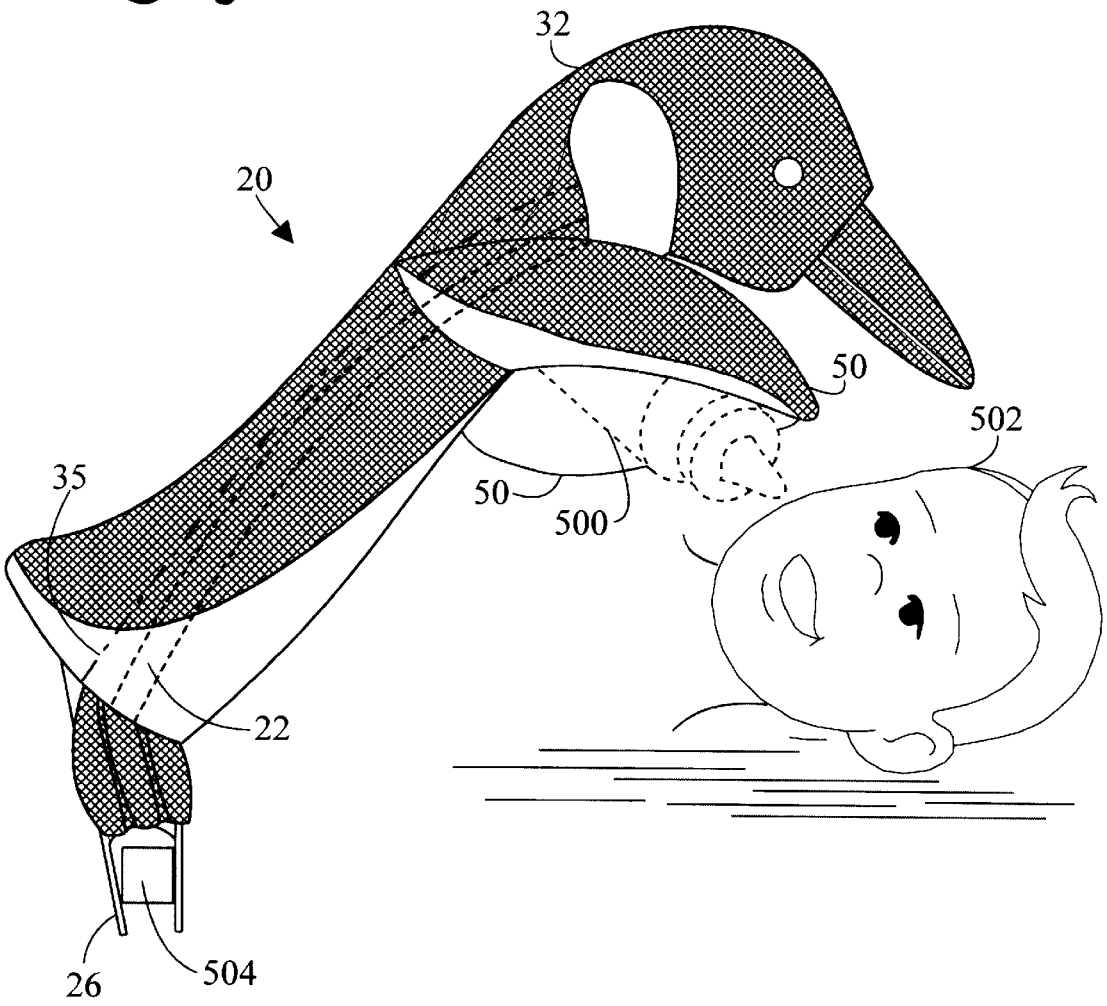
FIG. 1 is a perspective view of a holder for a baby bottle in accordance with the present invention.
Figure 2:
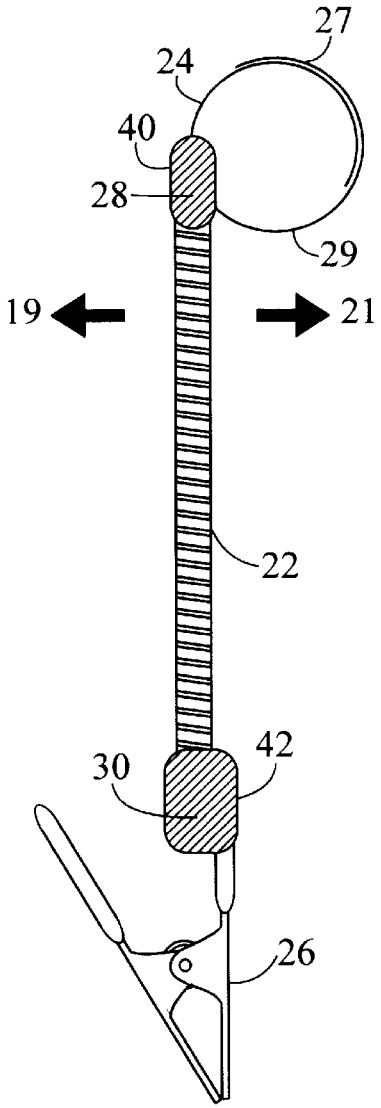
FIG. 2 is an end elevation view of a flexible arm, bottle receiver, and clamp.
Figure 3:
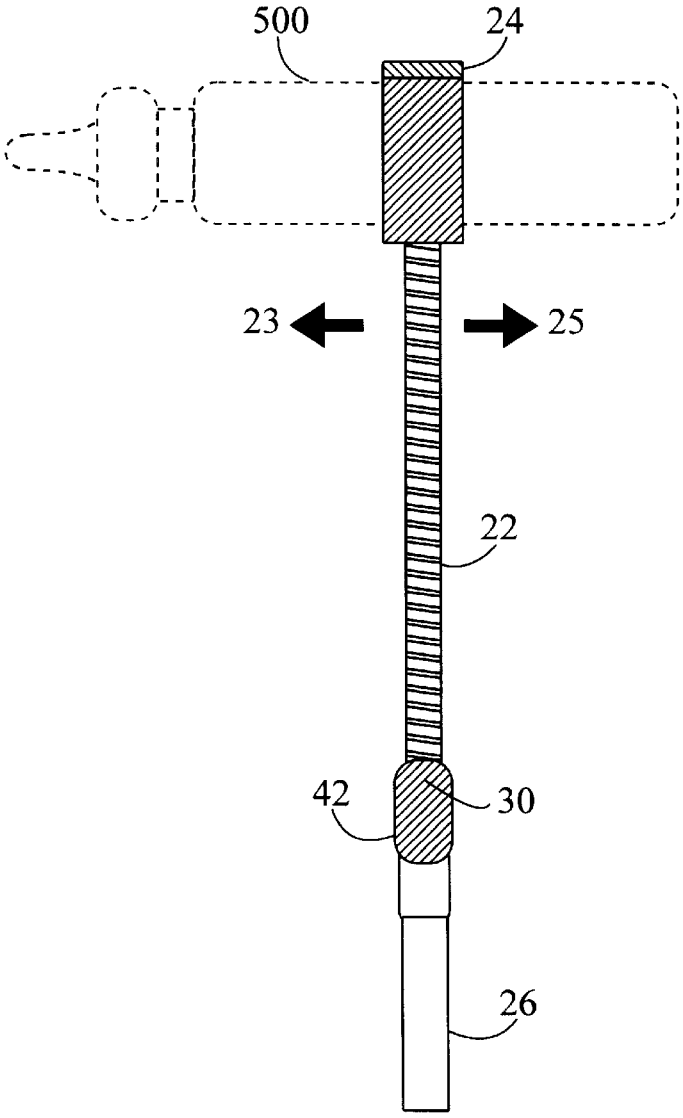
FIG. 3 is an side elevation view of FIG. 2.

Referring initially to FIG. 1, there is illustrated a perspective view of a holder for a baby bottle in accordance with the present invention, generally designated as 20. FIG. 2 is an end elevation view of a flexible arm 22, a bottle receiver 24, and a clamp 26 used in the holder. FIG. 3 is a side elevation view of FIG. 2. Flexible arm 22 has a first end 28 and an opposite second end 30. Flexible arm 22 is bendable into various positions in directions 19, 21, 23, and 25 thereby making it possible to adjust the relative position and orientation of bottle receiver 24 with respect to clamp 26. Once bent into position, flexible arm 22 retains the desired configuration. In a preferred embodiment, flexible arm 22 is similar in construction to the neck of a common desk lamp.

Bottle receiver 24 is connected to first end 28 of flexible arm 22. Bottle receiver 24 receives a baby bottle 500 which is used to feed a baby 502. Bottle receiver 24 is fabricated from soft pliable material and contains no solid parts or sharp edges that could harm the baby 502. In a preferred embodiment, bottle receiver 24 comprises cooperating bands 27 and 29 of hook and loop material. The bands are snugly wrapped around baby bottle 500 to firmly hold it in place. Bottle receiver 24 may be adjusted to accommodate virtually any size baby bottle 500. Clamp 26 is connected to second end 30 of flexible arm 22, can be of any convenient design, and is used to secure holder 20 onto a support structure 504 such as a crib. In the shown preferred embodiment, clamp 26 is a spring clamp similar to the clamps on battery cables.

Figure 4:
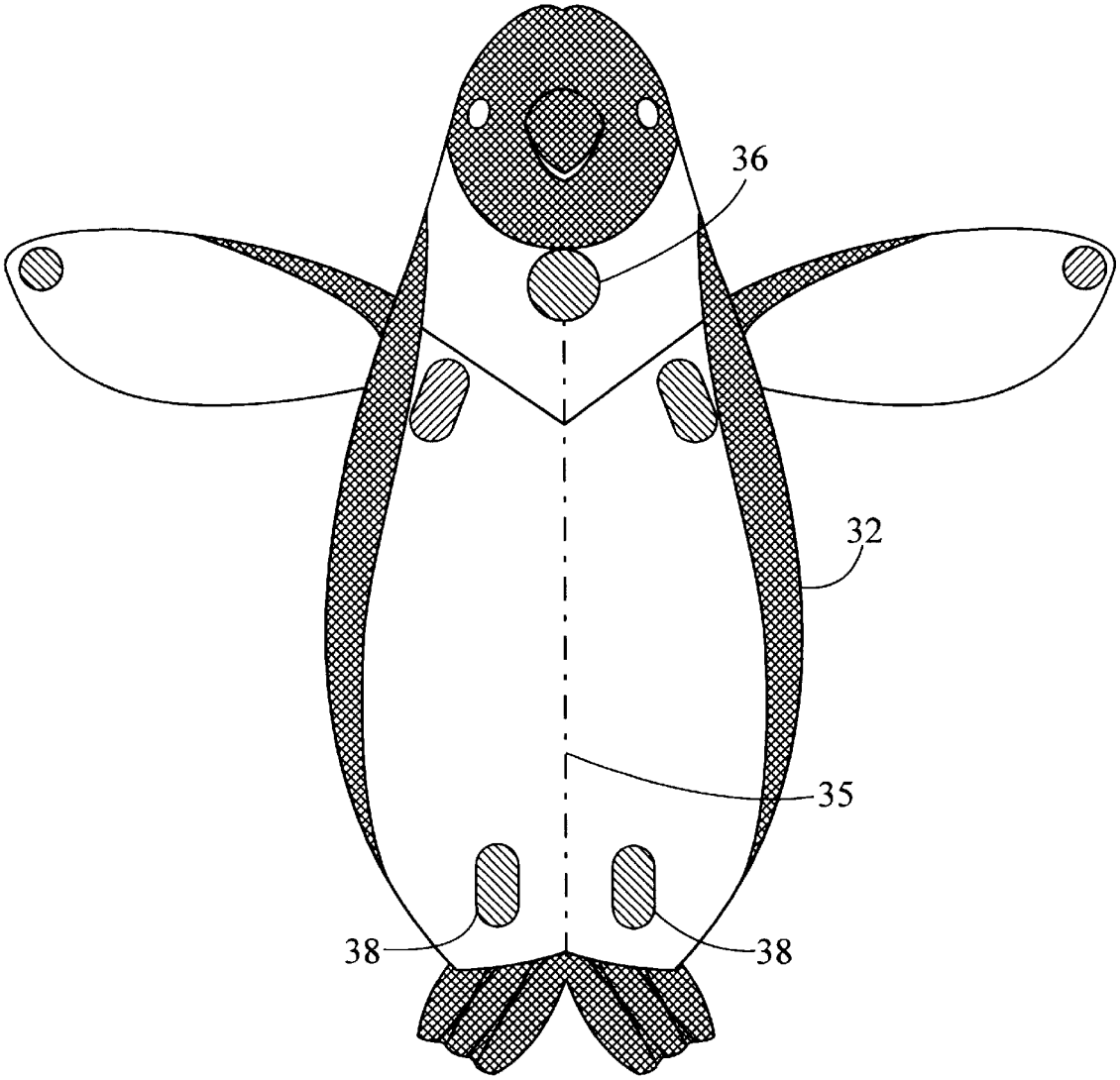
FIG. 4 is a side elevation view of a decorative cover.
Figure 5:
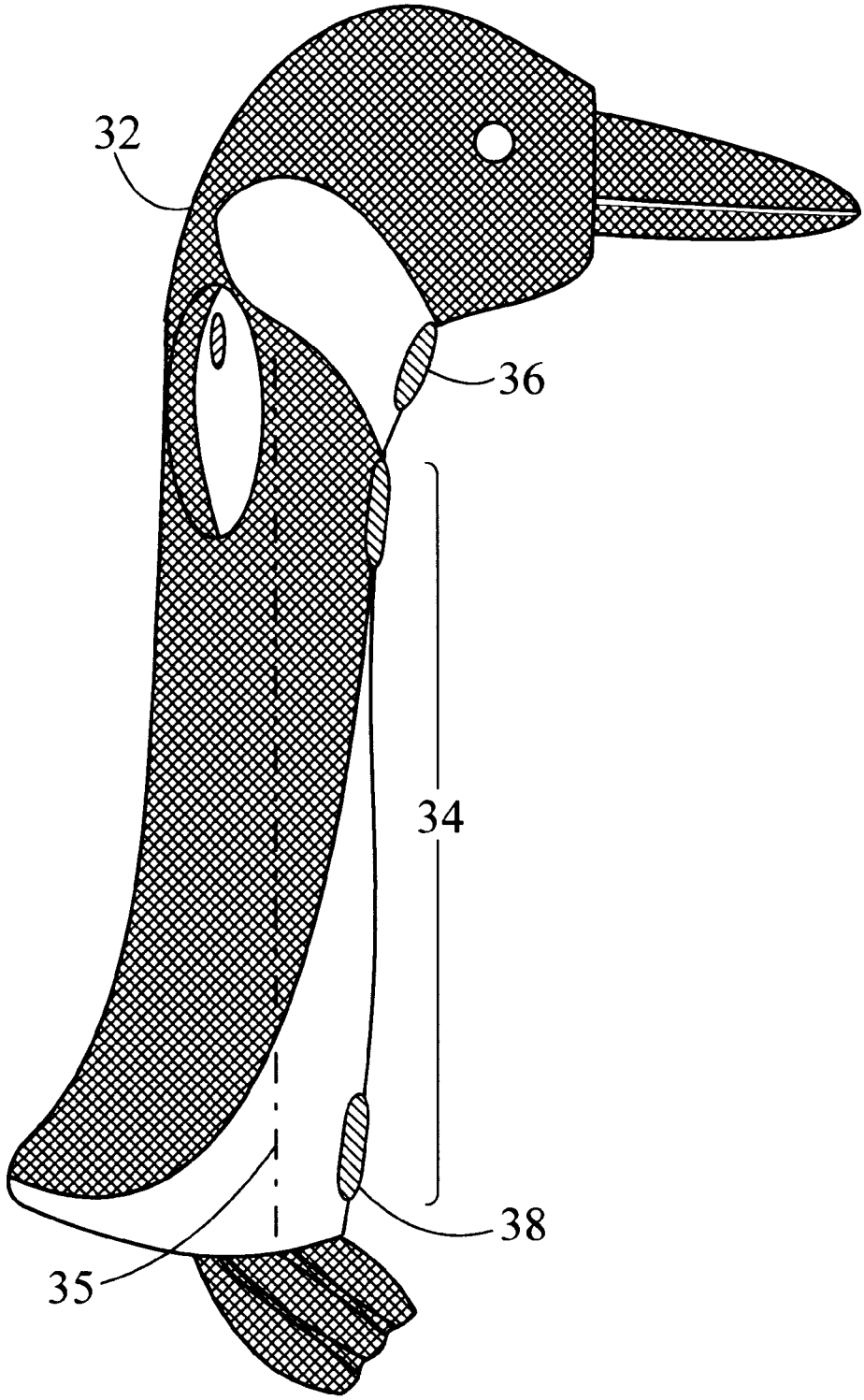
FIG. 5 is an end elevation view of FIG. 4.

FIG. 4 is a side elevation view of a decorative cover 32 for the holder. FIG. 5 is an end elevation view of FIG. 4. Decorative cover 32 is removably attachable to first end 28 and second end 30 of flexible arm 22 shown in FIG. 2. Decorative cover 32 is in the form of an animal which has an imaginary flexible spinal axis 35. In a preferred embodiment, the animal of decorative cover 32 has a body portion 34 which is flattened, thereby facilitating the process of wrapping decorative cover 32 around flexible arm 22. Decorative cover 32 has a first connection point 36 and a second connection point 38.

Figure 6:
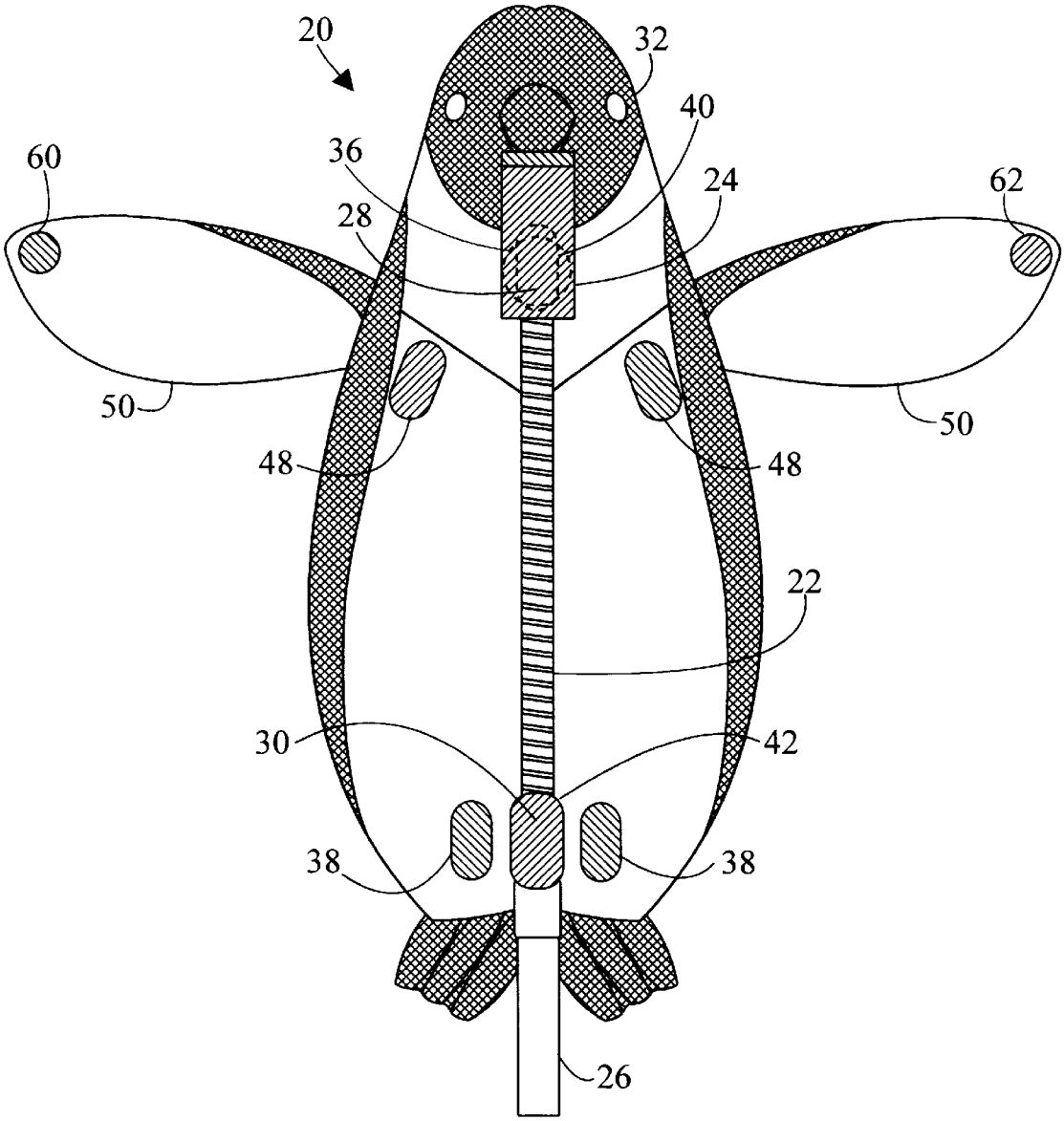
FIG. 6 is a side elevation view of the flexible arm, bottle receiver, and clamp placed longitudinally adjacent the front of the decorative cover; and, FIG. 7 is a side elevation view of the decorative cover wrapped around the flexible arm.

FIG. 6 is a side elevation view of flexible arm 22, bottle receiver 24, and clamp 26 placed adjacent the front of decorative cover 32 in a ready to be wrapped position. When attached to and wrapped around or straddling flexible arm 22, the spinal axis 35 of the animal (FIGS. 3 and 4) is substantially codirectional with flexible arm 22 (FIG. 1). That is, the animal is lying with its front side along flexible arm 22 with the head and neck of the animal located near first end 28 and bottle receiver 24, and the groin of the animal located near second end 30 and clamp 26. Flexible arm 22 has a first connection point 40 disposed at first end 28 and a second connection point 42 disposed at second end 30 (refer also to FIG. 2). The first connection point 36 of decorative cover 32 includes one of hook and loop fastening material, and first connection point 40 of flexible arm 22 includes the other of hook and loop fastening material. Similarly, second connection point 38 of decorative cover 32 includes one of hook and loop fastening material, and second connection point 42 of flexible arm 22 includes the other of hook and loop fastening material. First connection point 36 of decorative cover 32 is located near the neck 44 of the animal, and second connection point 38 of decorative cover 32 is located near a groin 46 of the animal. When decorative cover 32 is attached to flexible arm 22, first connection point 36 of decorative cover 32 cooperates with first connection point 40 of flexible arm 22, and second connection point 38 of decorative cover 32 cooperates with first connection point 42 of flexible arm 22. In accordance with a preferred embodiment of the invention, the second connection point 38 near the groin of the animal includes two spaced apart connection points. Also, in a preferred embodiment, connection points 40 and 42 of flexible arm 22 comprise loop fastening material, and connection points 36 and 38 of decorative cover 32 comprise hook fastening material.

Figure 7:
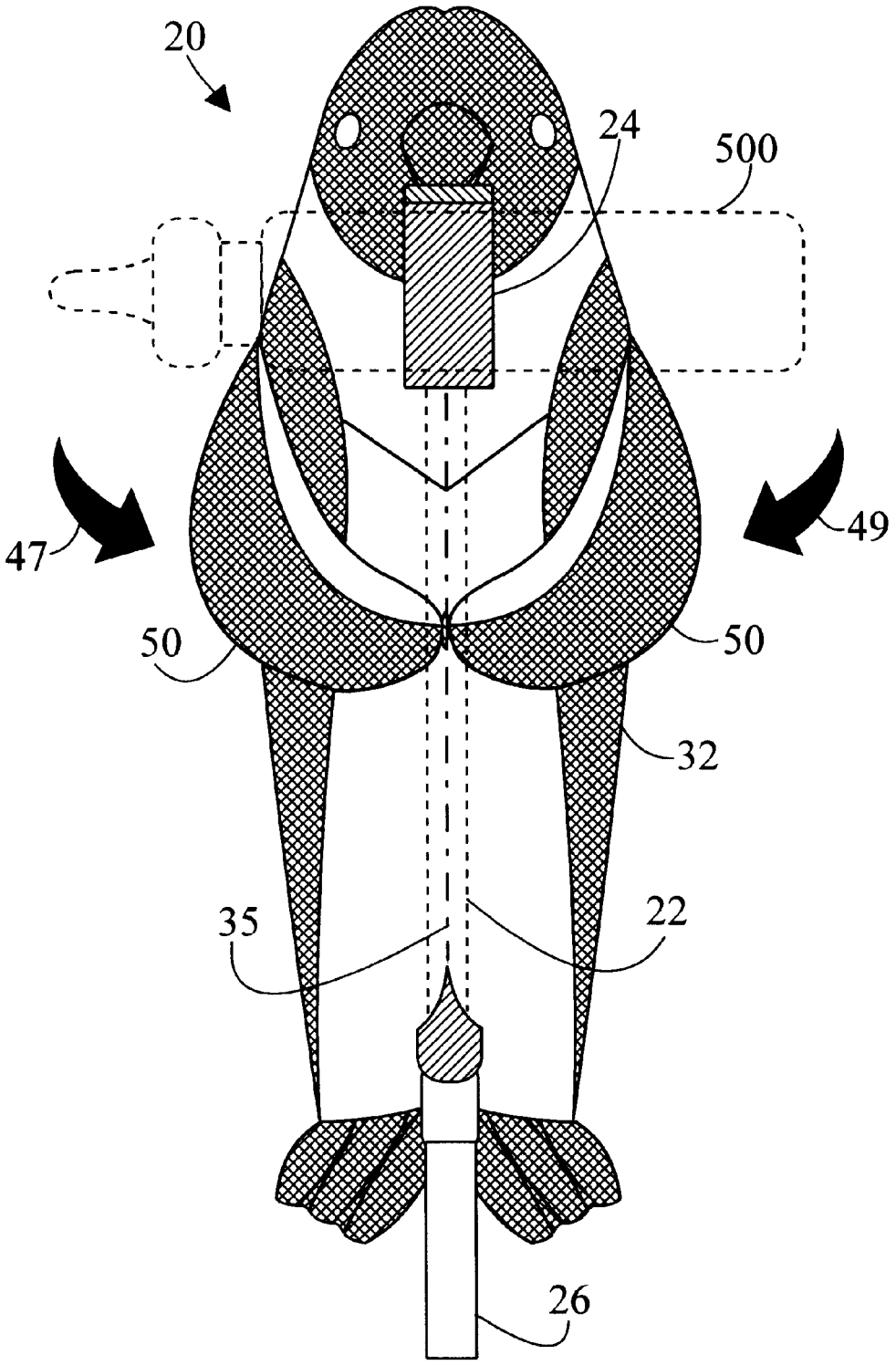

Referring also to FIG. 7, to effect the wrapping of decorative cover 32 around flexible arm 22, decorative cover 32 has two spaced cooperating fasteners 48 located on opposite sides of the chest of the animal. The two spaced cooperating fasteners 48 selectively retain decorative cover 32 around flexible arm 22. In a preferred embodiment, one of the two spaced cooperating fasteners 48 includes hook fastening material, and the other of two spaced cooperating fasteners 48 includes loop fastening material. In FIG. 7, decorative cover 32 has been wrapped around flexible arm 22 in directions 47 and 49.

The animal of decorative cover 32 has at least two opposing limbs 50. If the animal is a bird such as is shown, the two limbs 50 comprise wings. It may be appreciated however, that if the animal is four legged, such as a dog or cat, the animal would have two opposing front legs 50 and two opposing rear legs. Two limbs 50 are selectively fastened together so as to surround flexible arm 22. Again, this is accomplished by a pair of cooperating hook and loop fasteners 60 and 62. In a preferred embodiment, two limbs 50 can be fastened together so as to surround baby bottle 502 and give the impression the animal is holding the baby bottle 502 (refer also to FIG. 1).

Using the holder for a baby bottle 20 to feed a baby may be accomplished by attaching the baby bottle 500 to bottle receiver 24, wrapping the decorative cover 32 around flexible arm 22 so that the head of the animal is near bottle receiver 24 and the groin of the animal is near clamp 26, attaching clamp 26 to a support structure 504, and positioning flexible arm 22 so that baby bottle 500 is accessible to the baby 502. After repeated use, decorative cover 32 may be removed from flexible arm 22 for cleaning.

The preferred embodiments of the invention described herein are exemplary and numerous modifications, dimensional variations, and rearrangements can be readily envisioned to achieve an equivalent result, all of which are intended to be embraced within the scope of the appended claims.

We claim:

1. A holder for a baby bottle, comprising:

a flexible arm having a first end and an opposite second end;

a bottle receiver connected to said first end;

a clamp connected to said second end;

a decorative cover in the form of an animal having a spinal axis;

said decorative cover removably attachable to said first and second ends of said flexible arm, so that said spinal axis is substantially codirectional with said flexible arm; and, said decorative cover having two spaced cooperating fasteners located on a chest of said animal, and said two spaced cooperating fasteners selectively retaining said decorative cover around said flexible arm.

2. A holder for a baby bottle comprising:

a flexible arm having a first end and an opposite second end;

a bottle receiver connected to said first end;

a clamp connected to said second end;

a decorative cover in the form of an animal having a spinal axis;

said decorative cover removably attachable to said first and second ends of said flexible arm, so that said spinal axis is substantially codirectional with said flexible arm;

said decorative cover having a first connection point and a second connection point;

said flexible arm having a first connection point disposed at said first end and a second connection point disposed at said second end;

said first connection point of said decorative cover including one of a hook and loop fastening material, and said first connection point of said flexible arm including the other of a hook and loop fastening material;

said second connection point of said decorative cover including one of a hook and loop fastening material, and said second connection point of said flexible arm including the other of a hook and loop fastening material;

said first connection point of said decorative cover located near a neck of said animal, and said second connection point of said decorative cover located near a groin of said animal, so that said animal is disposed longitudinally along said flexible arm;

said second connection point of said decorative cover including two spaced connection points;

said decorative cover having two spaced cooperating fasteners located on a chest of said animal, said two spaced cooperating fasteners selectively retaining said decorative cover around said flexible arm;

said animal having at least two limbs;

said at least two limbs selectively fastenable together so as to surround the baby bottle when the baby bottle is disposed within said bottle receiver;

said decorative cover having a body portion which is substantially flat; and, said bottle receiver being fabricated from pliable material.

3. A holder for a baby bottle, comprising:

a flexible arm having a first end and an opposite second end;

a bottle receiver connected to said first end;

a clamp connected to said second end;

a decorative cover in the form of an animal having a spinal axis;

said decorative cover removably attachable to said first and second ends of said flexible arm, so that said spinal axis is substantially codirectional with said flexible arm;

said decorative cover having a first connection point and a second connection point;

said flexible arm having a first connection point disposed at said first end and a second connection point disposed at said second end;

said first connection point of said decorative cover having one of a hook and loop fastening material, and said first connection point of said flexible arm having the other of a hook and loop fastening material; and, said second connection point of said decorative cover having one of a hook and loop fastening material, and said second connection point of said flexible arm having the other of a hook and loop fastening material.

4. A holder for a baby bottle according to claim 3, wherein said first connection point of said decorative cover is located near a neck of said animal and said second connection point of said decorative cover is located near a groin of said animal.

5. A holder for a baby bottle according to claim 4, further including said second connection point of said decorative cover having two spaced apart connection points.

* * * * *